US008960667B2

(12) United States Patent
Nakamura

(10) Patent No.: US 8,960,667 B2
(45) Date of Patent: Feb. 24, 2015

(54) SHEET DISCHARGE TRAY AND IMAGE FORMING APPARATUS INCLUDING THE SAME

(71) Applicant: KYOCERA Document Solutions Inc., Osaka-shi, Osaka (JP)

(72) Inventor: Satoru Nakamura, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/243,784

(22) Filed: Apr. 2, 2014

(65) Prior Publication Data

US 2014/0300048 A1 Oct. 9, 2014

(30) Foreign Application Priority Data

Apr. 5, 2013 (JP) ..... 2013-079749

(51) Int. Cl.
*B65H 31/00* (2006.01)
*B65H 31/02* (2006.01)
*B65H 31/20* (2006.01)

(52) U.S. Cl.
CPC ..... *B65H 31/02* (2013.01); *B65H 31/20* (2013.01); *B65H 2301/4212* (2013.01); *B65H 2403/411* (2013.01); *B65H 2405/1114* (2013.01); *B65H 2405/1412* (2013.01); *B65H 2601/325* (2013.01); *B65H 2801/06* (2013.01)
USPC ..... 271/209

(58) Field of Classification Search
CPC ..... B65H 31/00; B65H 31/26; B65H 31/32; B65H 31/34; B65H 2405/1111; B65H 2405/1114; B65H 2405/11151; B65H 2405/1412; B65H 2405/20; B65H 2405/211; B65H 2405/2111
USPC ..... 271/207, 209
See application file for complete search history.

(56) References Cited

U.S. PATENT DOCUMENTS

| | | | | |
|---|---|---|---|---|
| 7,631,864 | B1 * | 12/2009 | Howe et al. | 271/207 |
| 7,748,705 | B2 * | 7/2010 | Yamada | 271/209 |
| 8,016,287 | B2 * | 9/2011 | Watanabe | 271/209 |
| 8,777,217 | B2 * | 7/2014 | Watanabe | 271/209 |
| 8,783,679 | B2 * | 7/2014 | Ono | 271/207 |
| 2006/0017219 | A1 * | 1/2006 | Yamada | 271/209 |
| 2008/0067737 | A1 * | 3/2008 | Kosuda et al. | 271/207 |
| 2013/0075969 | A1 * | 3/2013 | Akiyama | 271/207 |

FOREIGN PATENT DOCUMENTS

| | | | | |
|---|---|---|---|---|
| JP | 05319663 A | * | 12/1993 | 271/207 |
| JP | 06056328 A | * | 3/1994 | 271/209 |
| JP | 2005330067 A | | 12/2005 | |

* cited by examiner

*Primary Examiner* — David H Bollinger
(74) *Attorney, Agent, or Firm* — Alleman Hall McCoy Russell & Tuttle LLP

(57) ABSTRACT

A sheet discharge tray according to one aspect of the present disclosure includes an inclined support surface and a rib. The inclined support surface is inclined downward toward a sheet discharge portion and is configured to support a paper sheet discharged from the sheet discharge portion. The rib is provided along the inclined support surface. The rib has a larger elevation angle relative to a horizontal plane as compared to an angle of the inclined support surface.

12 Claims, 9 Drawing Sheets

SHEET DISCHARGE TRAY AND IMAGE FORMING APPARATUS INCLUDING THE SAME

INCORPORATION BY REFERENCE

This application is based upon and claims the benefit of priority from the corresponding Japanese Patent Application No. 2013-079749 filed on Apr. 5, 2013, the entire contents of which are incorporated herein by reference.

BACKGROUND

The present disclosure relates to a sheet discharge tray and an image forming apparatus.

There have been known image forming apparatuses such as copying machines and printers that form images by electrophotography. In such image forming apparatuses, an image is formed on each paper sheet through a predetermined electrophotographic process. The paper sheet on which the image has been formed is discharged from the apparatus by a sheet discharge roller and stacked on a sheet discharge tray. Some sheet discharge trays have an inclined support surface inclined downward toward a sheet discharge portion. Such a sheet discharge tray allows the discharged paper sheets to slide on the inclined support surface, thereby stacking the paper sheets with trailing ends of the paper sheets aligned with each other.

In order to improve sheet stocking efficiency in the sheet discharge tray, the inclined support surface may be provided with a stopper. The stopper contacts with leading ends of the discharged paper sheets to prevent misalignment of the paper sheets in a front-back direction and prevent falling of the paper sheets stacked on the sheet discharge tray, improving the sheet stocking efficiency in the sheet discharge tray.

SUMMARY

A sheet discharge tray according to one aspect of the present disclosure includes an inclined support surface and a rib. The inclined support surface is inclined downward toward a sheet discharge portion and is configured to support a paper sheet discharged from the sheet discharge portion. The rib is provided along the inclined support surface. The rib has a larger elevation angle relative to a horizontal plane as compared to an angle of the inclined support surface.

An image forming apparatus according to another aspect of the present disclosure includes a sheet discharge portion, a sheet discharge tray, and a rib. The sheet discharge portion is configured to discharge a paper sheet. The sheet discharge tray has an inclined support surface inclined downward toward the sheet discharge portion and is configured to support the paper sheet discharged from the sheet discharge portion. The rib is provided along the inclined support surface. The rib has a larger elevation angle relative to a horizontal plane as compared to an angle of the inclined support surface.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment of the present disclosure will be described with reference to the drawings. In the embodiment described below, a copying machine having a document reading function will be described as an example of an image forming apparatus including a sheet discharge tray according to the present disclosure.

(First Embodiment)

Figure 2:
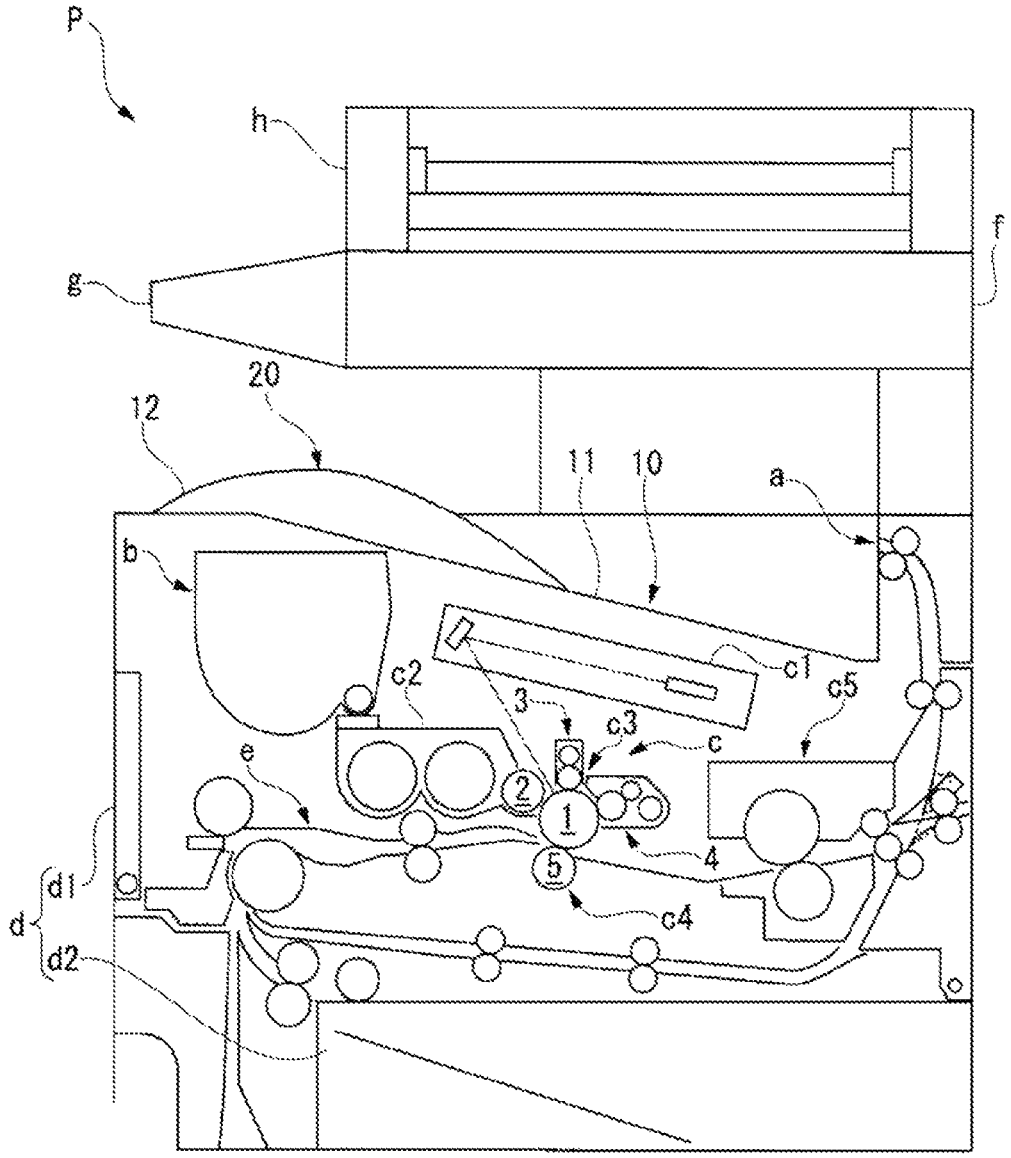
FIG. 2 is a diagram showing an internal structure of the copying machine according to the first embodiment of the present disclosure.

As shown in FIG. 2, a copying machine (image forming apparatus) P includes a sheet discharge portion (a), a toner storage portion (b), an image forming portion (c), and a sheet feed portion (d). The copying machine P also includes a conveyance portion (e) extending from the sheet feed portion (d) located in a lower part to the sheet discharge portion (a) located in an upper part. The copying machine P further includes a scanner portion (f), an operation portion (g), and a document feed portion (h) above the sheet discharge portion (a).

The sheet discharge portion (a) is configured to discharge, through the conveyance portion (e), paper sheets (sheet member) on which a given image has been formed. A sheet discharge tray 10 to be described below is provided below the sheet discharge portion (a). A support surface of the sheet discharge tray 10 is inclined, and thus the sheet discharge tray 10 is designed to stack discharged paper sheets with trailing ends of the paper sheets aligned.

The toner storage portion (b) includes a toner container storing black toner (BK), for example, and is configured to supply the toner to a developing unit c2 of the image forming portion (c).

The image forming portion (c) includes a laser scanning unit c1, the developing unit c2, a drum unit c3, a transfer unit c4, and a fixing unit c5.

Like a well-known laser scanning unit, the laser scanning unit c1 includes a light beam generator that generates laser light, a polygon mirror that scans the light beam emitted by the light beam generator, an fθ lens that focuses the light beam scanned by the polygon mirror on a photosensitive drum 1 to be described below, and the like.

The developing unit c2 develops an electrostatic latent image formed on a circumferential surface of the photosensitive drum 1 by supplying the toner to the photosensitive drum 1. The developing unit c2 has a developing roller 2 disposed so as to face the circumferential surface of the photosensitive drum 1 in a radial direction of the roller.

The drum unit c3 has the photosensitive drum 1. On the circumferential surface of the drum, an electrostatic latent image is generated using the laser scanning unit c1, and a toner image is formed with the toner supplied from the toner storage portion (b) to the developing unit c2.

A charging device 3 that charges the circumferential surface of the photosensitive drum 1, a cleaner 4 that removes the toner remaining on the circumferential surface of the photosensitive drum 1 after image transfer, and like are disposed so as to face each other around the photosensitive drum 1. In the present embodiment, the charging device 3, the cleaner 4, and the like together with the photosensitive drum 1 are detachably unitized as the drum unit c3.

The transfer unit c4 has a transfer roller 5 disposed so as to face the circumferential surface of the photosensitive drum 1 in a radial direction of the roller. The transfer roller 5 is provided so as to be pressed against the photosensitive drum 1.

Accordingly, the transfer roller 5 can rotate as the photosensitive drum 1 is driven to rotate. When a predetermined sheet member, for example, a paper sheet is conveyed to the transfer roller 5 through the conveyance portion (e), the transfer roller 5 can rotate with the paper sheet interposed between the transfer roller 5 and the photosensitive drum 1, and thus the paper sheet can be conveyed toward the fixing unit c5.

The fixing unit c5 is provided at a part of the conveyance portion (e) downstream of the transfer unit c4 and includes a pair of rollers arranged so as to be capable of having, therebetween, each paper sheet being conveyed through the conveyance portion (e). The fixing unit c5 is configured to fix, on each paper sheet, a toner image transferred on the paper sheet by the transfer unit c4, by pressurization and heating with the pair of rollers.

The sheet feed portion (d) includes a sheet feed tray d1 provided so as to be openable and closable with respect to an apparatus main body, and a sheet feed cassette d2 provided so as to be drawable with respect to the apparatus main body. The sheet feed portion (d) is configured to feed paper sheets one by one from the sheet feed tray d1 or the sheet feed cassette d2 to the conveyance portion (e).

The conveyance portion (e) extends from the sheet feed portion (d) located in a lower part to the sheet discharge portion (a) located in an upper part and includes a plurality of conveyance rollers and guide plates. The conveyance portion (e) is configured to convey the paper sheets fed from the sheet feed portion (d) one by one toward the sheet discharge portion (a).

The scanner portion (f) reads a set document and acquires document image data representing an image on the document. The scanner portion (f) includes a CCD (Charge Coupled Device) sensor (not shown) mounted on a carriage and is configured to read a document set on a contact glass (not shown) or a document sequentially fed by the document feed portion (h).

The operation portion (g) outputs signals (operation signals) according to operations by a user and displays various pieces of information such as information of the state of the copying machine P. The operation portion (g) includes operation keys g1 and an operation display portion g2 (see FIG. 1). The operation keys g1 are hardware keys such as a copy start key, a copy stop/clear key, a numerical keypad (numerical entry key), and a function switch key. The operation display portion g2 is a touch panel disposed so as to face a display screen of a liquid crystal panel or an organic electroluminescence panel and outputs signals representing coordinates of regions pressed by a user as the operation signals.

The document feed portion (h) is a device that automatically feeds documents to be read in sequence. The document feed portion (h) introduces a document stored in a sheet feed tray h1 into a conveyance path (not shown) going through the scanner portion (f) using a pickup roller (not shown) and discharges the document to a sheet discharge tray h2. The scanner portion (f) includes a slit-like contact glass (not shown) other than the contact glass on which a document is set. A document automatically fed by the document feed portion (h) is read through the slit-like contact glass.

In the copying machine P having the above-described structure, laser light corresponding to image data is applied from the laser scanning unit c1 to the photosensitive drum 1 to form an electrostatic latent image, and the electrostatic latent image is developed into a toner image with supplied toner. The toner image carried on the photosensitive drum 1 is then transferred onto each paper sheet by the transfer unit c4, and subsequently fixed by being pressurized and heated by the fixing unit c5. Lastly, each paper sheet on which the image has been printed is discharged from the sheet discharge portion (a) to the sheet discharge tray 10.

Next, a structure of the sheet discharge tray 10 provided in the copying machine P having the above-described structure will be described in detail with reference to FIGS. 3 and 4.

Figure 3:
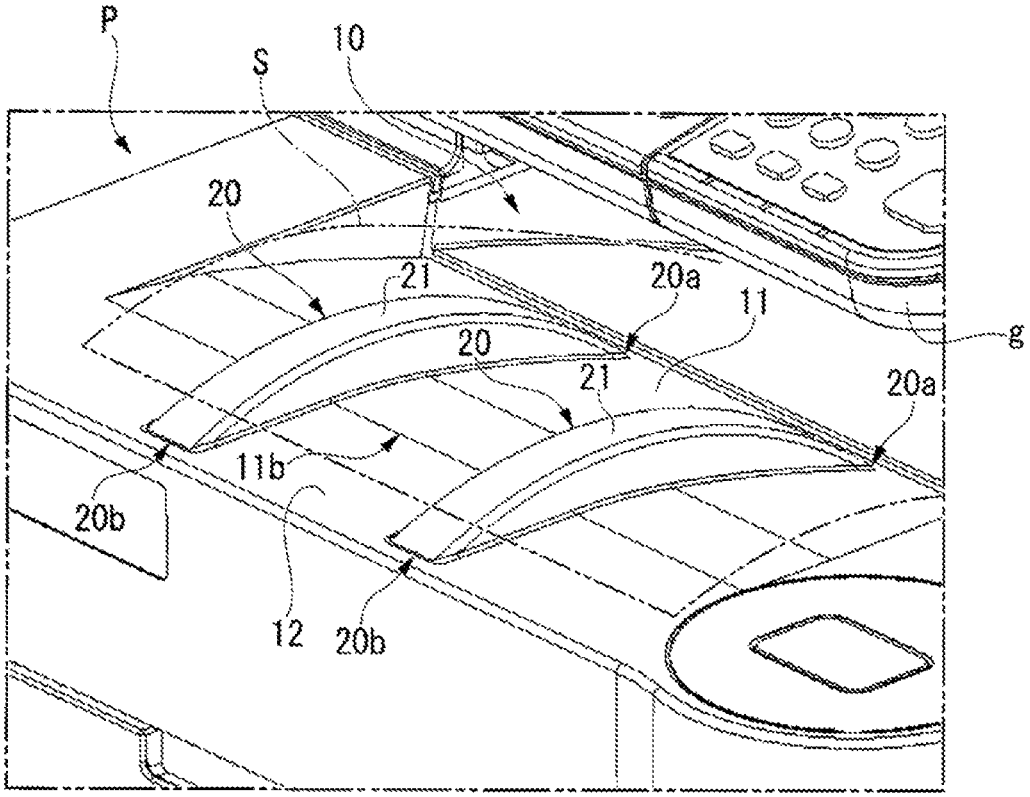
FIG. 3 is a perspective view showing an outer appearance of a sheet discharge tray according to the first embodiment of the present disclosure.

As shown in FIG. 3, the sheet discharge tray 10 is provided such that its front surface faces the front side of the copying machine P. The operation portion (g) is provided above the sheet discharge tray 10. The sheet discharge portion (a) is provided on the rear side of the copying machine P, and thus each paper sheet (represented by a reference character S in FIG. 3) is discharged from the rear side toward the front side of the copying machine P. Accordingly, a user accesses a paper sheet supported on the sheet discharge tray 10 by inserting his/her hand under the operation portion (g).

Figure 4:
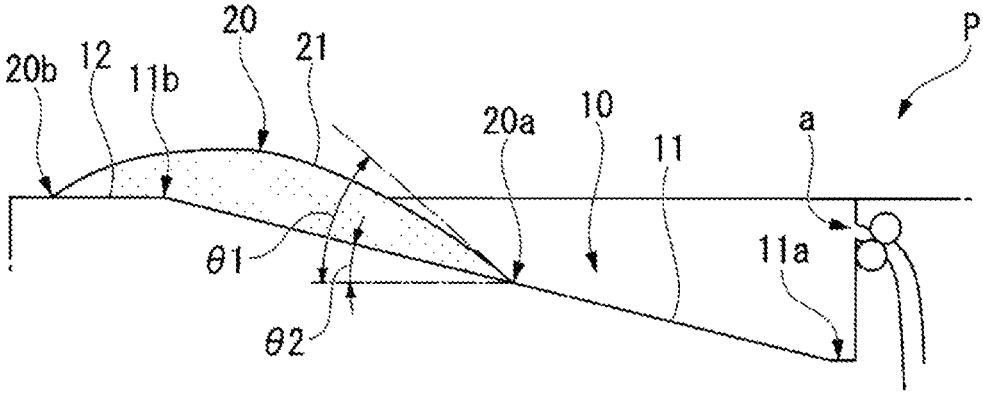
FIG. 4 is a diagram showing a relationship between an elevation angle of an inclined support surface and an elevation angle of a rib according to the first embodiment of the present disclosure.

As shown in FIG. 4, the sheet discharge tray 10 has an inclined support surface 11 that is inclined downward toward the sheet discharge portion (a). That is, the inclined support surface 11 is inclined downward toward the rear side of the copying machine P. A lower end 11*a* of the inclined support surface 11 is located substantially vertically below the sheet discharge portion (a). On the other hand, an upper end 11*b* of the inclined support surface 11 is located away from the sheet discharge portion (a) and higher than the sheet discharge portion (a).

The sheet discharge tray 10 also has a horizontal support surface 12 that extends continuously from the upper end 11*b* of the inclined support surface 11. Unlike the inclined support surface 11, the horizontal support surface 12 is not inclined and extends horizontally. The horizontal support surface 12 extends from the upper end 11*b* of the inclined support surface 11 toward the front side of the copying machine P. That is, the horizontal support surface 12 is located farther from the sheet discharge portion (a) than the inclined support surface 11 and higher than the sheet discharge portion (a).

The sheet discharge tray 10 has ribs 20 provided along the inclined support surface 11. According to the present embodiment, as shown in FIG. 3, a plurality of the ribs 20 (two ribs in the present embodiment) are provided at intervals in a width direction of the inclined support surface 11. The ribs 20 adjacent to each other in the width direction extend toward the sheet discharge portion (a) in pairs in parallel with each other. The ribs 20 extend diagonally along the inclination of the inclined support surface 11.

As shown in FIG. 4, lower ends 20*a* of the ribs 20 are located on the inclined support surface 11 without extending the ribs 20 to positions substantially vertically below the sheet discharge portion (a). That is, the lower ends 20*a* of the ribs 20 are away from the sheet discharge portion (a) with a part of the inclined support surface 11 interposed between the sheet discharge portion (a) and the lower ends 20*a*. Upper ends 20*b* of the ribs 20 are located on the horizontal support surface 12. That is, the ribs 20 of the present embodiment extend over the inclined support surface 11 and the horizontal support surface 12. As described above, the ribs 20 are provided on an entrance side of the sheet discharge tray 10 (front side of the copying machine P).

As shown in FIG. 4, the ribs 20 have an arcuate shape. That is, the ribs 20 are formed so as to be arch-shaped. Accordingly, top surfaces 21 of the ribs 20 form a contour shape having a gentle curve. Each rib 20 has a larger elevation angle $\theta 1$ relative to the horizontal plane as compared to an angle of the inclined support surface 11. That is, a relational expression $\theta 1 > \theta 2$ is satisfied, wherein $\theta 2$ is an angle of the inclined support surface 11. Furthermore, each rib 20 does not form a right angle with the inclined support surface 11; a relational expression $\theta 2 - \theta 1 < 90°$ is satisfied. The elevation angle of the ribs 20 of the present embodiment refers to an angle at which a tangent line to each upper surface 21 at each lower end 20*a* intersects the horizontal plane.

Subsequently, effects of the sheet discharge tray 10 having the above-described structure will be described.

As shown in FIG. 2, paper sheets on which a given image has been printed in the image forming portion (c) of the copying machine P are discharged from the sheet discharge portion (a) to the sheet discharge tray 10. On the rear side of the copying machine P, the sheet discharge portion (a) is opened toward the front side of the copying machine P so that each paper sheet is discharged toward the front side of the copying machine P. As shown in FIG. 4, the sheet discharge tray 10 has the inclined support surface 11 that is inclined downward toward the sheet discharge portion (a). Accordingly, the paper sheets discharged from the sheet discharge portion (a) slide toward the rear side of the copying machine P along the inclined support surface 11 due to their own weight, and the trailing ends thereof are aligned by hitting against a side wall below the sheet discharge portion (a).

A conventional sheet discharge tray includes a projection (stopper) that contacts with leading ends of paper sheets in order to improve the sheet stocking efficiency. However, if the stopper is provided to the sheet discharge tray 10 of the copying machine P, the stopper may prevent a user from accessing paper sheets and taking the paper sheets from the sheet discharge tray 10 along a sheet discharge direction.

The sheet discharge tray 10 of the present embodiment has the ribs 20 which are provided along the inclined support surface 11 and which have a larger elevation angle $\theta 1$ relative to the horizontal plane as compared to the angle of the inclined support surface 11. The ribs 20 are elevated higher than the inclined support surface 11 to form a discharge stock angle in the sheet discharge tray 10. Thereby, the paper sheets discharged from the sheet discharge portion (a) can be prevented from, for example, easily going too far from the sheet discharge tray 10, thereby allowing improvement of the sheet stocking efficiency without providing a projection (stopper) as is conventionally provided.

Figure 1:
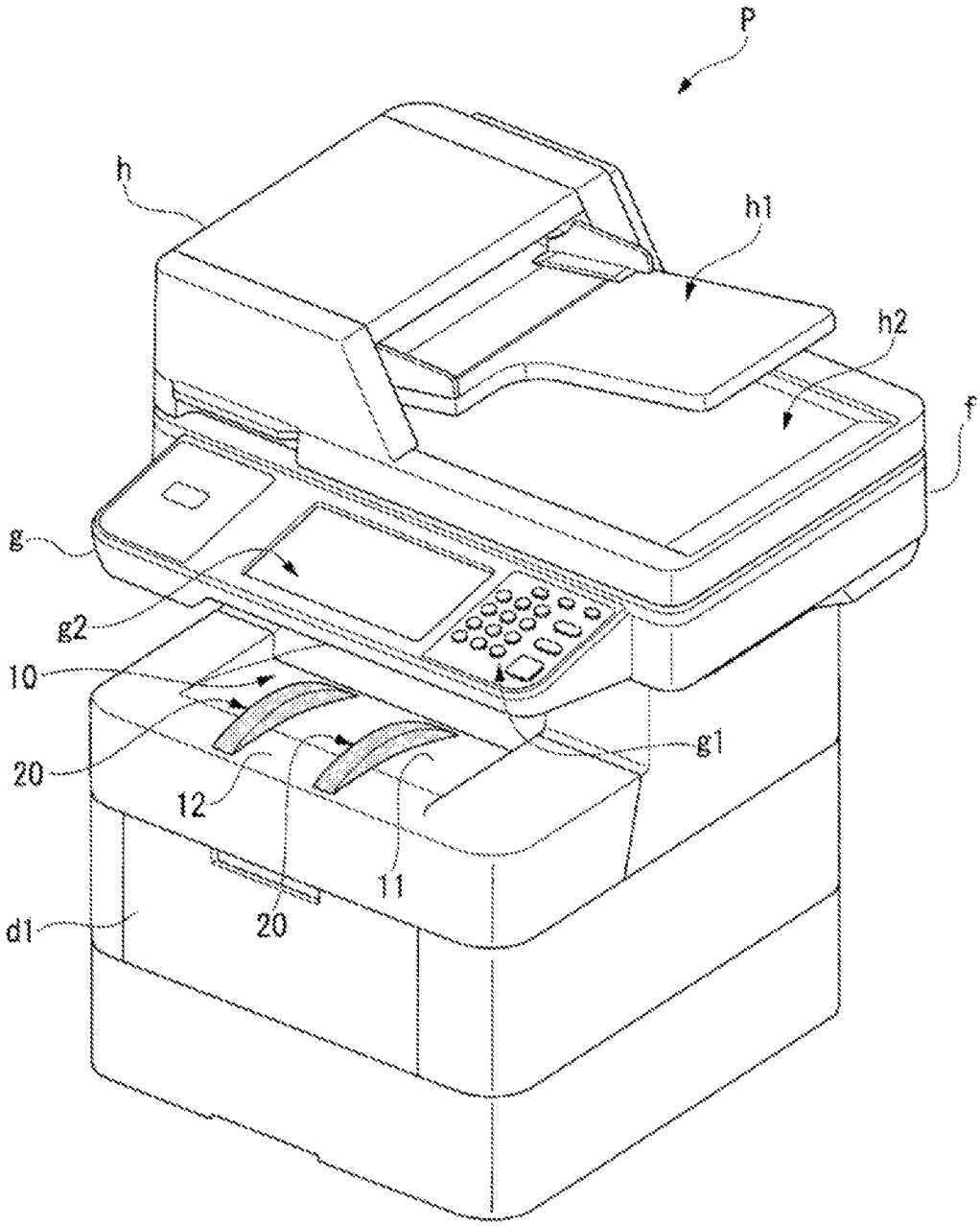
FIG. 1 is a perspective view showing an outer appearance of a copying machine according to a first embodiment of the present disclosure.

Furthermore, when the layout of the present embodiment is such that the operation portion (g), the scanner portion (f), and the document feed portion (h) are disposed above the sheet discharge tray 10 of the present embodiment as shown in FIG. 1, a user needs to insert his/her hand under the operation portion (g) to access the paper sheets supported on the sheet discharge tray 10, and therefore a direction in which the user accesses the paper sheets is limited to the sheet discharge direction (direction in which the user's hand is inserted from the front side of the copying machine P). A space under the operation portion (g) is usually small if a projection (stopper) is provided to the sheet discharge tray 10 in order to form a discharge stock angle.

In the present embodiment, the ribs 20 are provided along the inclined support surface 11. A user trying to access the paper sheets along the sheet discharge direction can therefore insert his/her hand along the ribs 20 as shown in FIG. 3. Thus, sheet removability can be satisfactorily obtained while sheet stocking efficiency can be satisfactorily obtained.

The ribs 20 of the present embodiment have an arcuate shape. According to this structure, the outer shape of the ribs 20 is formed by a gentle curve as shown in FIG. 4, thereby preventing the user's hand accessing the paper sheets along the sheet discharge direction from hitting against a corner and allowing removal of the paper sheets by sliding the hand on the top surfaces 21 of the ribs 20. Thus, it is possible to improve the sheet removability.

The ribs 20 of the present embodiment extend over the inclined support surface 11 and the horizontal support surface 12 that extends continuously from the upper end 11*b* of the inclined support surface 11. According to this structure, the horizontal support surface 12 is elevated and a space can be formed between the horizontal support surface 12 and the ribs 20. Since the user's hand is usually inserted horizontally, the space formed at the horizontal support surface 12 on the front side facilitates the insertion of the user's hand under the paper sheets. Thus, it is possible to improve the sheet removability.

In the present embodiment, as shown in FIG. 3, the ribs 20 are provided at intervals in the width direction of the inclined support surface 11. According to this structure, the paper sheets are supported by the two ribs 20, and a large space can be formed between the ribs 20 adjacent to each other in the width direction. Therefore, in this structure, the insertion of the user's hand under the paper sheets is facilitated as compared to a structure having one rib 20. Thus, it is possible to further improve the sheet removability.

According to the present embodiment, as described above, the ribs 20 are provided along the inclined support surface 11, and therefore it is possible to satisfactorily obtain sheet removability as well as sheet stocking efficiency also when a user accesses the paper sheets along the sheet discharge direction.

(Second Embodiment)

Next, a second embodiment of the present disclosure will be described. In the following description, the same or corresponding components as described for the above embodiment are denoted by the same reference numerals, and description thereof will be simplified or omitted.

Figure 5:
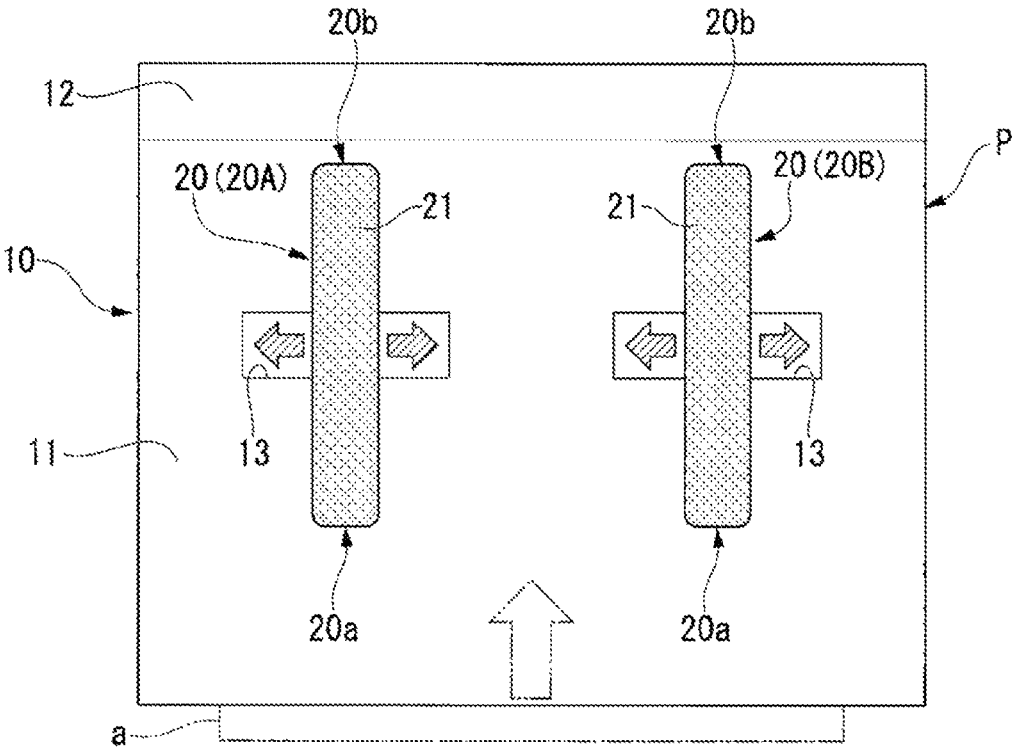
FIG. 5 is a plan view showing a structure of a sheet discharge tray according to a second embodiment of the present disclosure.

As shown in FIG. 5, the second embodiment is different from the first embodiment in that the ribs 20 (a first rib 20A and a second rib 20B) adjacent to each other in the width direction are configured such that the space therebetween is adjustable.

The ribs 20 of the second embodiment are provided on the inclined support surface 11. That is, the upper ends 20*b* of the ribs 20 are located on the inclined support surface 11. The inclined support surface 11 is provided with slide grooves 13.

The slide grooves 13 are provided to the first rib 20A and the second rib 20B, respectively. The first rib 20A and the second rib 20B are configured to be movable in the width direction of the inclined support surface 11 along the slide grooves 13. A range in which the first rib 20A and the second rib 20B can move is set within the width of the sheet discharge portion (a).

Figure 6:
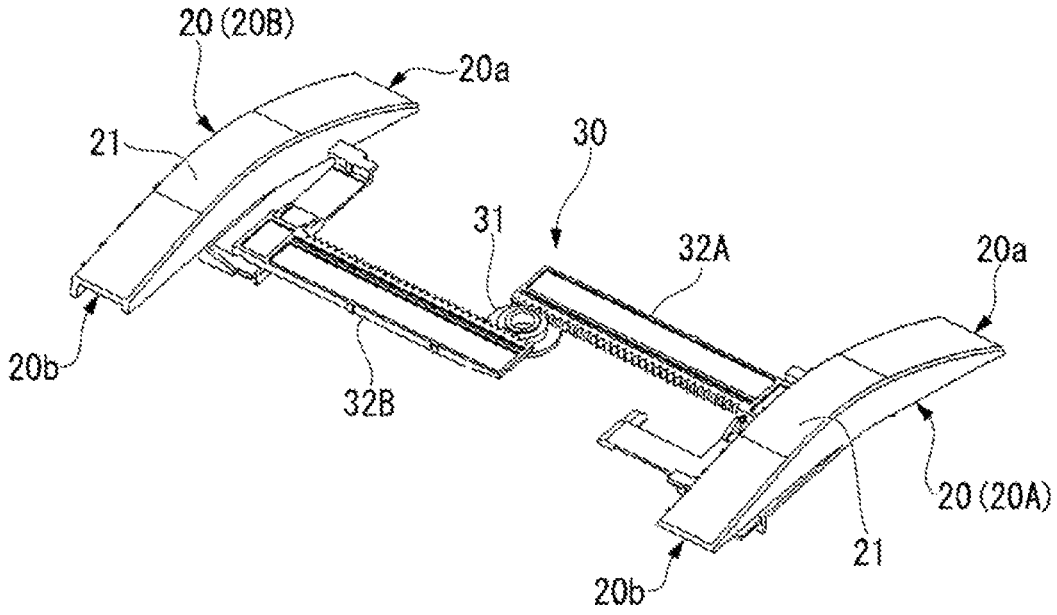
FIG. 6 is a perspective view showing a structure of a rib space adjustor according to the second embodiment of the present disclosure.

In the present embodiment, the first rib 20A and the second rib 20B are moved in synchronization by a rib space adjustor 30 shown in FIG. 6. The rib space adjustor 30 is provided on a surface opposite to the inclined support surface 11 and connects between the first rib 20A and the second rib 20B by a rack and pinion mechanism. The rib space adjustor 30 has a pinion 31 provided between the first rib 20A and the second rib 20B, a rack 32A connected to the first rib 20A, and a rack 32B connected to the second rib 20B.

The pinion 31 is provided so as to be rotatable about an axis extending perpendicular to the inclined support surface 11. The outer circumference of the pinion 31 is provided with a gear in meshing engagement with the rack 32A and the rack 32B. The rack 32A and the rack 32B are elongated members each provided with a gear on a side. The rack 32A and the rack 32B are arranged so as to face each other via the pinion 31. According to this structure, the rack 32A and the rack 32B can be moved in synchronization in opposite directions by the rotation of the pinion 31.

According to the second embodiment having the above-described structure, the rib space adjustor 30 is provided, and thereby it is possible to adjust the space between the first rib 20A and the second rib 20B adjacent to each other in the width direction of the inclined support surface 11 as shown in FIG. 3. The first rib 20A and the second rib 20B are movable in synchronization in opposite directions relative to the center of the sheet discharge portion (a) as a center of the movement within the range of the width of the sheet discharge portion (a). Accordingly, the ribs 20 can conform with any types of paper sheets (A4 size, B5 size, and like) to be discharged from the sheet discharge portion (a).

When paper sheets to be discharged from the sheet discharge portion (a) have a smaller width, for example, the first rib 20A and the second rib 20B are moved inward to allow the paper sheets to be supported on the first rib 20A and the second rib 20B, and appropriately form a space for the user to insert his/her hand between the first rib 20A and the second rib 20B adjacent to each other in the width direction. When paper sheets to be discharged from the sheet discharge portion (a) are less pliable, for example, the adjustment of the space between the first rib 20A and the second rib 20B will be more flexible, and therefore the space between the first rib 20A and the second rib 20B can be adjusted according to the size of the user's hand.

According to the second embodiment, as described above, the structure having the rib space adjustor 30 that allows adjustment of the space between the first rib 20A and the second rib 20B adjacent to each other in the width direction is employed to allow the size of the space under the paper sheets for the user to insert his/her hand to be adjusted according to the type of the paper sheets or to the user. Thus, it is possible to improve the sheet removability.

(Third Embodiment)

Next, a third embodiment of the present disclosure will be described. In the following description, the same or corresponding components as described for the above embodiments will be denoted by the same reference numerals, and description thereof will be simplified or omitted.

Figure 7:
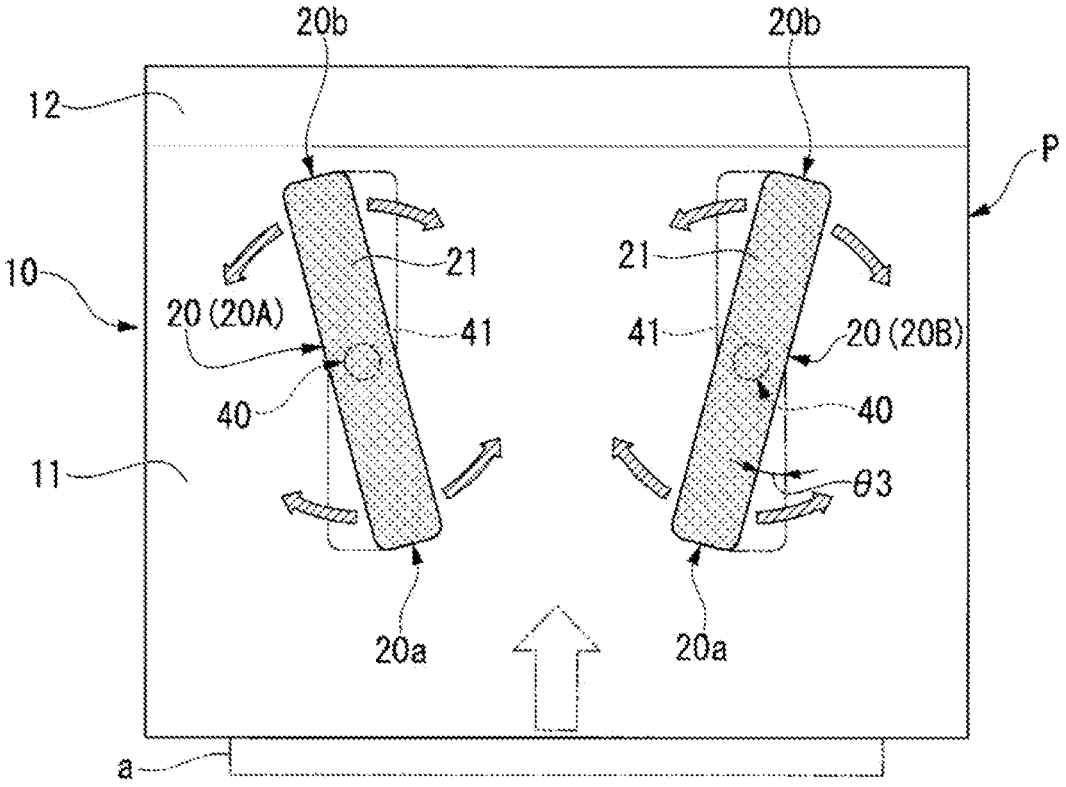
FIG. 7 is a plan view showing a structure of a sheet discharge tray according to a third embodiment of the present disclosure.

As shown in FIG. 7, the third embodiment is different from the first and second embodiments in that the ribs 20 (the first rib 20A and the second rib 20B) adjacent to each other in the width direction are configured such that the mounting angles thereof are adjustable.

Figure 8:
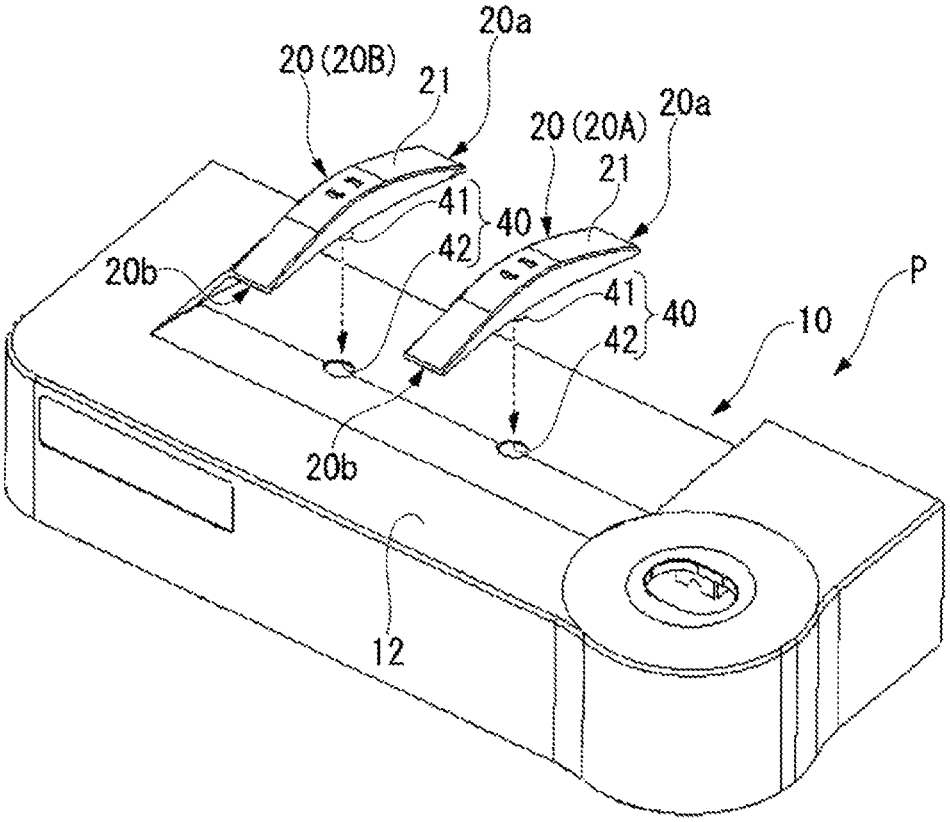
FIG. 8 is an exploded perspective view showing a structure of a rib mounting angle adjustor according to the third embodiment of the present disclosure.

The ribs 20 of the third embodiment are provided on the inclined support surface 11. That is, the upper ends 20*b* of the ribs 20 are located on the inclined support surface 11. The inclined support surface 11 is provided with rib mounting angle adjustors 40. As shown in FIG. 8, the rib mounting angle adjustors 40 each have a shaft portion 41 provided on a lower surface of each rib 20 and a hole portion 42 provided in the inclined support surface 11.

Figure 9A:
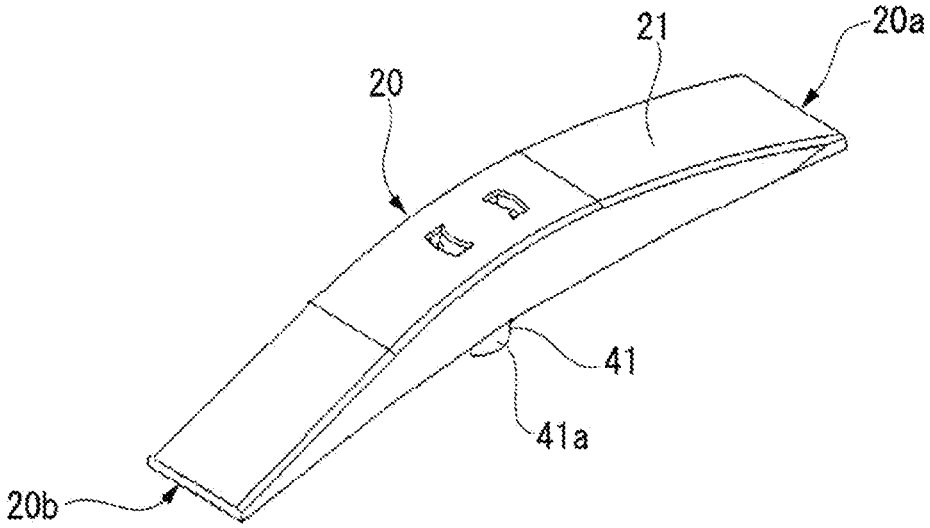
FIGS. 9A and 9B are a top perspective view and a bottom perspective view, respectively, showing a structure of a rib according to the third embodiment of the present disclosure.
Figure 9B:
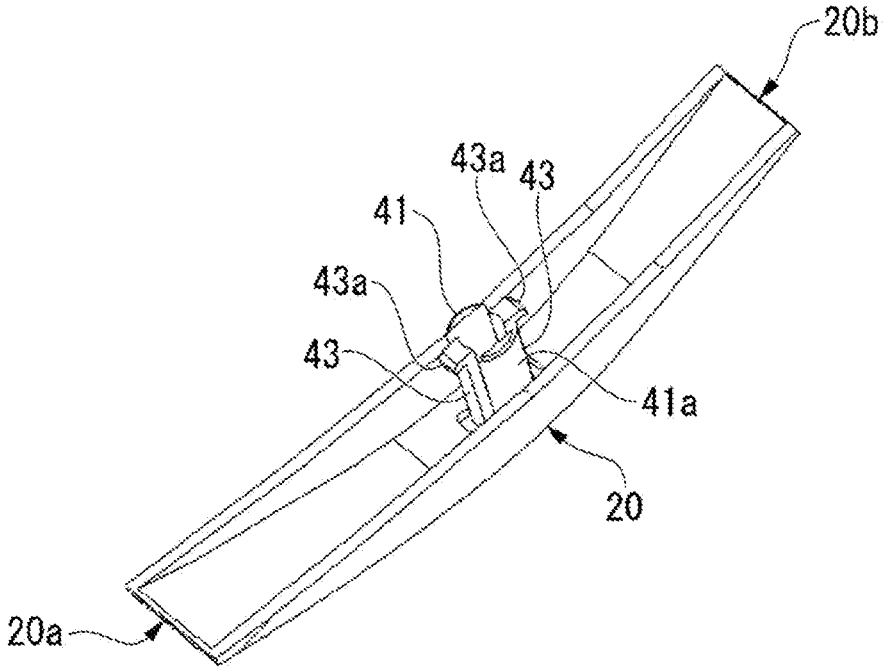

Each shaft portion 41 is provided in the center of each rib 20 as shown in FIG. 9A. The shaft portions 41 are formed integrally with the ribs 20, respectively. Furthermore, each shaft portion 41 has hook portions 43 formed by vertically dividing a circumferential surface 41*a* of the shaft portion 41 as shown in FIG. 9B. The hook portions 43 are arranged in pairs in a length direction of each rib 20. Lower ends 43*a* of the hook portions 43 are bent outward. The hook portions 43 are deformable inward of the circumferential surface 41*a* of the shaft portion 41 due to the material of the hook portions 43 having springiness.

The shaft portions 41 having the above-described structure are inserted in the respective hole portions 42 provided in the inclined support surface 11 as shown in FIG. 8. As each shaft portion 41 is inserted, the hook portions 43 are deformed inward. Once the lower ends 43*a* of the hook portions 43 go below the hole portions 42, the hook portions 43 are deformed outward and restored to be latched on the surface opposite to the inclined support surface 11. Thereby, the ribs 20 are mounted on the inclined support surface 11. The hole portions 42 are formed perpendicular to the inclined support surface 11. Each rib 20 is therefore rotatable about an axis extending perpendicular to the inclined support surface 11 as shown in FIG. 7, and thus the mounting angle thereof (represented by a reference character θ3 in FIG. 7) is adjustable.

In the third embodiment having the above-described structure, the mounting angle of the first rib 20A and the mounting angle of the second rib 20B can be independently adjusted by the respective rib mounting angle adjustors 40. In the third embodiment, in addition, the mounting angles of the first rib 20A and the second rib 20B adjacent to each other in the width direction are adjusted such that the greater the distance from sheet discharge portion (a) is, the greater the space between the first rib 20A and the second rib 20B is, in a planar view. Adjusting the mounting angles as described above allows the space between the first rib 20A and the second rib 20B to be smaller near the sheet discharge portion (a) such that the greater the distance from the sheet discharge portion (a) is, the greater the space therebetween is.

That is, the first rib 20A and the second rib 20B adjacent to each other in the width direction extend such that the greater the distance from the sheet discharge portion (a) is, the greater the space between the first rib 20A and the second rib 20B is, in a planar view, thereby widening an entrance of the space under the paper sheets from which the user trying to access the paper sheets inserts his/her hand along the sheet discharge direction. Thus, it is possible to improve the sheet removability. Since the space between the first rib 20A and the second rib 20B is smaller near the sheet discharge portion (a), the paper sheets can be supported by the first rib 20A and the second rib 20B even when the paper sheets discharged from the sheet discharge portion (a) have a smaller width. Thus, it is possible to appropriately form the space for the user to insert his/her hand between the first rib 20A and the second rib 20B adjacent to each other in the width direction.

According to the third embodiment, as described above, the structure is employed in which the first rib 20A and the second rib 20B adjacent to each other in the width direction extend such that the greater the distance from the sheet discharge portion (a) is, the greater the space between the first rib 20A and the second rib 20B is, in a planar view, thereby widening the entrance of the space under the paper sheets from which the user trying to access the paper sheets inserts his/her hand along the sheet discharge direction. Thus, it is possible to improve the sheet removability. According to the third embodiment, in addition, the structure having the rib mounting angle adjustors that allows adjustment of the mounting angles of the first rib 20A and the second rib 20B relative to the inclined support surface 11 is employed, thereby allowing the size of the entrance of the space under the paper sheets for the user to insert his/her hand to be adjusted according to the type of the paper sheets or to the user.

While the preferred embodiments of the present disclosure have been described with reference to the drawings as above, the present disclosure is not limited to the above-described embodiments. The shapes, the combinations, and the like of the components described in the embodiments discussed above are merely exemplary, and variations and modifications based on design requirements or the like may be made without departing from the gist of the present disclosure.

For example, while the structure in which the ribs have an arcuate shape has been described in the embodiments above, the present disclosure is not limited to the structure, and the ribs may have a triangular shape or a semicircular shape along the inclined support surface, for example.

For another example, while the structure in which the inclined support surface is provided with two ribs has been described in the embodiments above, the present disclosure is not limited to the structure, and the inclined support surface may be provided with one rib or with three or more ribs, for example.

For another example, while the structure in which the inclined support surface is inclined at a predetermined angle has been described in the embodiments above, the present disclosure is not limited to the structure, and a structure may be employed in which the inclined support surface is inclined while making a wide curve, for example.

For another example, while the structure in which the sheet discharge tray has the inclined support surface and the horizontal support surface has been described in the embodiments above, the present disclosure is not limited to the structure, and the present disclosure can be applied to a structure without the horizontal support surface.

For another example, while the structure in which the first rib and the second rib are connected and moved in synchronization in opposite directions by the rack and pinion mechanism has been described in the second embodiment, the present disclosure is not limited to the structure, and a structure may be employed in which the first rib and the second rib are engaged with the respective slide grooves separately and moved independently. In the case where the paper sheets are discharged near an end of the sheet discharge tray rather than near the center thereof, a structure may be employed in which one of the first rib and the second rib is fixed.

For another example, while the structure in which the space between the first rib and the second rib is manually adjusted has been described in the second embodiment, the present disclosure is not limited to the structure, and a structure may be employed in which the pinion is rotated by a motor and the driving of the motor is controlled according to the width of the paper sheets for printing so that the space between the first rib and the second rib is automatically adjusted, for example.

For another example, while the structure in which the mounting angles of the first rib and the second rib are manually adjusted has been described in the third embodiment, the present disclosure is not limited to the structure, and a structure may be employed in which the shaft portions are rotated by a motor and the driving of the motor is controlled according to the width of the paper sheets for printing so that the mounting angles of the first rib and the second rib are automatically adjusted, for example.

For another example, while the copying machine has been described as an example of an image forming apparatus in the embodiments above, the present disclosure can be applied to other image forming apparatuses such as printers and facsimile apparatuses, for example.

Furthermore, the present disclosure can be applied to a sheet discharge tray in an automatic document feeder (ADF), for example, as well as image forming apparatuses.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A sheet discharge tray comprising:

an inclined support surface inclined downward toward a sheet discharge portion, the inclined support surface configured to support a paper sheet discharged from the sheet discharge portion;

a plurality of ribs provided along the inclined support surface, the plurality of ribs having a larger elevation angle relative to a horizontal plane as compared to an angle of the inclined support surface;

wherein the plurality of ribs are provided at intervals in a width direction of the inclined support surface, and wherein the sheet discharge tray further comprises a rib space adjustor configured to adjust a space between a first rib and a second rib of the plurality of ribs, the first rib and the second rib adjacent to each other in the width direction.

2. The sheet discharge tray according to claim 1, wherein at least one of the first rib and second rib extends over the inclined support surface and a horizontal support surface that extends continuously from an upper end of the inclined support surface.

3. The sheet discharge tray according to claim 1, wherein at least one of the first and the second rib has an arcuate shape.

4. The sheet discharge tray according to claim 1, wherein the first rib and the second rib adjacent to each other in the width direction extend such that the greater a distance from the sheet discharge portion is, the greater a space between the first rib and the second rib is, in a planar view.

5. The sheet discharge tray according to claim 1, wherein the first rib and the second rib adjacent to each other in the width direction extend such that the greater a distance from the sheet discharge portion is, the greater a space between the first rib and the second rib is, in a planar view.

6. A sheet discharge tray comprising:

an inclined support surface inclined downward toward a sheet discharge portion, the inclined support surface configured to support a paper sheet discharged from the sheet discharge portion;

a plurality of ribs provided along the inclined support surface, the plurality of ribs having a larger elevation angle relative to a horizontal plane as compared to an angle of the inclined support surface;

wherein the plurality of ribs are provided at intervals in a width direction of the inclined support surface, and wherein a first rib and a second rib of the plurality of ribs adjacent to each other in the width direction extend such that the greater a distance from the sheet discharge portion is, the greater a space between the first rib and the second rib is, in a planar view; and wherein the sheet discharge tray further comprises a rib mounting angle adjustor configured to adjust mounting angles of the first rib and the second rib relative to the inclined support surface.

7. An image forming apparatus comprising:

a sheet discharge portion configured to discharge a paper sheet;

a sheet discharge tray, having an inclined support surface inclined downward toward the sheet discharge portion, configured to support the paper sheet discharged from the sheet discharge portion; and a plurality of ribs provided along the inclined support surface, the plurality of ribs having a larger elevation angle relative to a horizontal plane as compared to an angle of the inclined support surface;

wherein the plurality of ribs are provided at intervals in a width direction of the inclined support surface, and wherein the image forming apparatus further comprises a rib space adjustor configured to adjust a space between a first rib and a second rib of the plurality of ribs, the first rib and the second rib adjacent to each other in the width direction.

8. The image forming apparatus according to claim 7, wherein the rib extends over the inclined support surface and a horizontal support surface that extends continuously from an upper end of the inclined support surface.

9. The image forming apparatus according to claim 7, wherein at least one of the first and the second rib has an arcuate shape.

10. The image forming apparatus according to claim 7, wherein the first rib and the second rib adjacent to each other in the width direction extend such that the greater a distance from the sheet discharge portion is, the greater a space between the first rib and the second rib is, in a planar view.

11. The image forming apparatus according to claim 7, wherein the first rib and the second rib adjacent to each other in the width direction extend such that the greater a distance from the sheet discharge portion is, the greater a space between the first rib and the second rib is, in a planar view.

12. An image forming apparatus comprising:

a sheet discharge portion configured to discharge a paper sheet;

a sheet discharge tray, having an inclined support surface inclined downward toward the sheet discharge portion, configured to support the paper sheet discharged from the sheet discharge portion; and a plurality of ribs provided along the inclined support surface, the plurality of ribs having a larger elevation angle relative to a horizontal plane as compared to an angle of the inclined support surface;

wherein the plurality of ribs are provided at intervals in a width direction of the inclined support surface, and wherein a first rib and a second rib of the plurality of ribs adjacent to each other in the width direction extend such that the greater a distance from the sheet discharge portion is, the greater a space between the first rib and the second rib is, in a planar view; and wherein the inclined support surface further comprises a rib mounting angle adjustor configured to adjust mounting angles of the first rib and the second rib relative to the inclined support surface.

* * * * *